US007857681B2

(12) United States Patent
Bonapace

(10) Patent No.: US 7,857,681 B2
(45) Date of Patent: Dec. 28, 2010

(54) AUTOMATIC ROTATION KNIFE SHARPENER

(76) Inventor: Mario J. Bonapace, P.O. Box 2733, Spring Valley, CA (US) 91979

( * ) Notice: Subject to any disclaimer, the term of this patent is extended or adjusted under 35 U.S.C. 154(b) by 0 days.

(21) Appl. No.: 12/431,702

(22) Filed: Apr. 28, 2009

(65) Prior Publication Data

US 2009/0275272 A1 Nov. 5, 2009

Related U.S. Application Data

(60) Provisional application No. 61/049,744, filed on May 1, 2008.

(51) Int. Cl.
*B24B 3/54* (2006.01)

(52) U.S. Cl. ..... 451/45; 451/349; 451/545

(58) Field of Classification Search ..... 451/553, 451/555, 344, 545, 45, 349; 76/82, 86, 88
See application file for complete search history.

(56) References Cited

U.S. PATENT DOCUMENTS 4,624,079 A * 11/1986 Bonapace ..... 451/555
4,646,477 A * 3/1987 Robertson ..... 451/540
4,912,885 A * 4/1990 Bonapace ..... 451/552

* cited by examiner

*Primary Examiner*—Robert Rose
(74) *Attorney, Agent, or Firm*—Richard D. Clarke

(57) ABSTRACT

The present invention is directed to an automatic rotation knife sharpener where the crossed sharpening rods are automatically rotated each time a knife is passed down and through the sharpener. The rotation is derived through the means of a spring steel actuator mechanism making contact with the cogwheels of the sharpening rod holders. Magnets retain the sharpening rods in place within the sharpening rod holders. Sharpening rods may be easily removed and stored in troughs on the upper surface of the protective cover. A variety of sharpening rods with different abrasive surfaces can be easily exchanged in the device.

20 Claims, 3 Drawing Sheets

AUTOMATIC ROTATION KNIFE SHARPENER

FIELD OF THE INVENTION

The present application relates to knife sharpeners and more particularly to a knife sharpener with a preset sharpening angle and automatically rotates the sharpening rods after the knife is drawn down through the device. A variety of sharpening rods with different abrasive surfaces can be easily exchanged in the device.

BACKGROUND OF THE INVENTION

There is a growing need for adequate knife sharpeners that can be used in a commercial application as well as in the home. Frequent sharpening of knives in commercial locations such as restaurants, food processing plants and the like is often required. Knife sharpening services provide sharp knives on a regular basis for these locations but the knives also require frequent dressing of the blade to keep it as sharp as needed. Most individuals at these locations use the hand held sharpening hone that has been used for ages and takes a good deal of dexterity to achieve a good edge along with having the possibility of cutting the operator when the knife is drawn toward the hand holding the honing device. When using this type of hone the angle of the knife is determined by the way the individual is holding the knife and hone, and may very with each stroke of the knife.

Various design's of knife sharpeners have been proposed in the past for purpose of sharpening knives providing some of the improvements needed, such as using the sharpening rods disposed in a crossed relationship giving a precise angle to the edge being sharpened, but requiring the sharpening rods to be turned manually to relocate the sharpening surface. The act of automatically rotating the sharpening rods may seem to be minimal, but during the sharpening action, the knife is often drawn through the device several times. In a commercial application, this operation will occur a great number of times each day. Most of these devices additionally have not addressed the capability of easily changing the sharpening rods to achieve different sharpening surface textures.

Numerous innovations for knife sharpeners have been provided in the prior art that are described as follows. Even though these innovations may be suitable for the specific individual purposes to which they address, they differ from the present design as hereinafter contrasted. The following is a summary of those prior art patents most relevant to this application at hand, as well as a description outlining the difference between the features of the automatic rotation knife sharpener and the prior art.

U.S. Pat. No. 4,530,188 of Louis N. Graves describes a pocketsize sharpening apparatus of the variety carrying sharpening rods disposed in crossed relationship. The sharpening apparatus has a body with a distal face carrying clips to releasably secure a pair of sharpening rods in crossed relationship. A major access opening permits access to portions of the sharpening rods from a proximal face of the body for sharpening a blade. The major access opening has a V-shaped portion extended inward from a mouth with convergent edges disposed in parallel relationship to and exposing convergent portions of the sharpening rods from the proximal face. A minor access opening is comprised as a slot extending inward of the body toward the major opening a sufficient distance to expose opposite intersecting portions of the sharpening rods. A peripheral protective lip can line the major and minor openings on the proximal face of the body. A groove can be provided in the body wherein the sharpening rods can be seated and manually held in side-by-side, parallel relationship for the sharpening of pointed objects.

This patent describes a pocket-sized sharpener with stationary crossing sharpening rods. With this device, the sharpening of a knife will always be on the same surface unless the sharpening rods are removed and replaced in a different position. The device requires that it be held in one hand with the knife held in the other risking injury to the hand holding the device if the knife were to be placed incorrectly.

U.S. Pat. No. 4,624,079 of Mario J. Bonapace tells of a knife sharpener having a pair of abrasive rod members whose bottom ends are mounted on carriages that are reciprocally mounted in channels formed in upstanding block members. The channels travel along an axis that is parallel to the downwardly sloping top surface of the block members. The block members are fixedly attached to the top surface of a base and the mouths of their channels face each other and are aligned on parallel offset axes. The rod members therefore intersect each other at a predetermined angle to form a V at their top into which a knife blade is drawn rearward along a horizontal plane to sharpen its edges. Each of the carriages has one of its ends fixedly attached to a spring whose opposite end is fixedly held in position. The downward force of the knife blade as it is being sharpened causes the rod members on the respective carriages to travel downward toward each other and when the pressure is released, the springs will return them to their initial unloaded positions.

This patent describes a knife sharpener having a pair of abrasive rod members whose bottom ends are mounted on carriages. This is another knife sharpener with crossing sharpening rods having the same problem where the sharpening action takes place on the same location of the sharpening rods, unless they are physically removed and repositioned.

U.S. Pat. No. 4,646,477 of William M. Robertson discloses a knife sharpener that includes a pair of arms pivoted together at their inner ends about a shaft to provide continuous adjustment of the angular orientation between sharpening sticks which are seated in the outer ends of the handles for continuous rotational adjustment, in order to provide precise sharpening.

This patent describes another knife sharpener with crossing sharpener rods. The sharpening rods may be rotated within their holders manually, but the holders are on a pivot allowing for different angle preferences. The sharpening rod holders do not have an adequate securing device to hold them in position. The device must also be held in one hand directly below the sharpening action of the knife blade.

U.S. Pat. No. 6,881,137 of Daniel D. Friel, Sr. describes a sharpener for blades that comprises a physical structure supporting at least one abrasive surface. A displaceable guiding plate having an integral linear structural feature of the support is disposed toward one side of the abrasive surface. The linear structural feature provides sliding contact with a face of the blade to establish the relative angle of the plane of the edge facet of the blade with the plane of the abrasive surface at the point of mutual contact as the facet is guided into contact with the abrasive surface.

This patent describes a structure supporting at least one angled abrasive surface. The knife rest against a guide surface during the sharpening operation but will always make contact with the same surface unless that surface is manually rotated.

U.S. Pat. No. 4,912,885 of Mario J. Bonapace describes a knife sharpener having a base, a pair of leg assemblies, a cover, and a pair of rod members formed of abrasive material. The leg assemblies each have an elongated leg member having a pivot pin passing downwardly there through to secure the leg member to the top surface of the base. The pivot ends of the respective leg assemblies are secured to the base at a position adjacent each other so that their free motion ends can pivot toward and away from each other. A spring is connected to the leg assemblies for maintaining a pressure that will force the free motion ends of the respective leg members apart from each other. The rod members are detachably supported in apertures formed in the top surface of the free motion ends of the respective leg members and the respective apertures are angularly oriented toward each other so that the rod members cross paths with one another to form a V and it is within this V that the blade of a knife would be passed in order to sharpen the cutting edge of the knife. The downward force of the knife blade when it is being sharpened causes the rod members on the respective leg members to pivot toward each other and when the pressure is released the spring will return them to their initial unloaded positions.

This patent of Mario J. Bonapace describes a similar knife sharpener described in this application with many of the same features accept that the sharpening rods do not rotate. The sharpening rods make contact with the knife at the same surface each time the device is used, unless they are manually repositioned. The sharpening rods are not held in place by magnets and are not easily removed. There is no place to store them on the device.

U.S. Pat. No. 7,172,500 of Wen-Chiu Wu discloses a knife sharpener that has a housing, a base, a sharpening device and an adjustable device. The housing has a case, a cavity and a slot. The cavity is defined in the case and the slot is defined in the case and communicates with the cavity. The base is mounted on the housing and has a base board and two side walls formed on the base board. The sharpening device is movable mounted on the base and is received inside the housing. The sharpening device has two sharpening arms with sharpening rods. The adjustable device is mounted on the sharpening device mounted between the two sharpening arms. When the knife sharpener is used, the adjustable device is rotated to change the cross-position of the sharpening device. Therefore, a knife may be sharpened at a different site on the sharpening rods for prolonging the life span of the knife sharpener.

This patent discloses a knife sharpener that when the device is used, the adjustable mechanism is rotated to change the cross-position on the sharpening rods. Therefore, a knife may be sharpened at a different site on the sharpening rods for a prolonged life span of the knife sharpener. With this device, the sharpening rods are moved up and down but are not rotated automatically along with the fact that the sharpening rods are not easily replaced.

None of these previous efforts, however, provides the benefits attendant with the automatic rotation knife sharpener. The present design achieves its intended purposes, objects and advantages over the prior art devices through a new, useful and unobvious combination of method steps and component elements, with the use of a minimum number of functioning parts, at a reasonable cost to manufacture, and by employing readily available materials.

In this respect, before explaining at least one embodiment of the in detail it is to be understood that the design is not limited in its application to the details of construction and to the arrangement, of the components set forth in the following description or illustrated in the drawings. The automatic rotation knife sharpener is capable of other embodiments and of being practiced and carried out in various ways. In addition, it is to be understood that the phraseology and terminology employed herein are for the purpose of description and should not be regarded as limiting. As such, those skilled in the art will appreciate that the conception, upon which this disclosure is based, may readily be utilized as a basis for designing of other structures, methods and systems for carrying out the several purposes of the present design. It is important, therefore, that the claims be regarded as including such equivalent construction insofar as they do not depart from the spirit and scope of the present application.

SUMMARY OF THE INVENTION

The principal advantage of the automatic rotation knife sharpener is that when a knife is passed down and over the sharpening rods they are automatically rotated where a different surface will be used during the next pass of the knife through the device.

Another advantage of the automatic rotation knife sharpener is having magnets in the base of the sharpening rod holder cavities to allow easy removal or for using sharpening rods with different abrasive surfaces.

Another advantage is the rod holders will also accommodate ceramic sharpening rods by the means of a steel cap fit over the end of the ceramic rods making them secure to the magnets in the base of the sharpening rod holder central cavities, and enabling a slip fit on and off the device.

Another advantage is the automatic rotation knife sharpener can be placed on a surface with the knife held in one hand and the other hand clear from the sharpening operation.

Another advantage with the automatic rotation knife sharpener is having a precise angle maintained for the knife as it passes over the sharpening rods.

Another advantage of the automatic rotation knife sharpener is having the sharpening rods and rod holders attached to spring loaded arms that keep a constant uniform pressure on the knife blade as it is drawn down through the device.

And still another advantage to the automatic rotation knife sharpener is that the sharpening rods can easily be removed and inserted into the two troughs on the top surface of the protective cover for storage of the device.

These together with other advantages of the automatic rotation knife sharpener, along with the various features of novelty, which characterize the design, are pointed out with particularity in the claims annexed to and forming a part of this disclosure. For a better understanding of the automatic rotation knife sharpener, its operating advantages and the specific objects attained by its uses, reference should be made to the accompanying drawings and descriptive matter in which there are illustrated preferred embodiments of the automatic rotation knife sharpener. There has thus been outlined, rather broadly, the more important features of the design in order that the detailed description thereof that follows may be better understood, and in order that the present contribution to the art may be better appreciated. There are additional features of the automatic rotation knife sharpener that will be described hereinafter and which will form the subject matter of the claims appended hereto.

The preferred embodiment of the automatic rotation knife sharpener will consist of a protective cover in an angular shape covering the top and sides, having two or more storage troughs on the top surface with a circular flexible retainer for the sharpening rods. An elongated orifice at the rear provides a means for the sharpening rods to translate back and forth through the protective cover during the sharpening operation. A slot at the back of the elongated orifice allows for clearance when the knife is drawn through the device. Three screws attach the protective cover to the two round pedestals mounted on the back of the automatic rotation knife sharpener frame and to the rectangular pedestal in the front.

Right and left pivot arms are attached to the frame by the means of socket head shoulder screws attaching through nylon washers. The right pivot arm has an extension with a Teflon® insert that mate with a depression in the left pivot arm creating a means whereby the right and left pivot arms rotate inwardly in unison. Flats on the forward distal ends of the right and left pivot arms abut the rectangular pedestal in the front of the device when the pivot arms are in the static position. A compression spring holds the right and left pivot arms apart while in the static position. Nylon glide pins provide additional support against the frame member for the right and left pivot arms when they translate back and forth in the sharpening operation. At the rear distal end of the right and left pivot arms are orifices at opposing angles of twenty-two degrees off perpendicular to the automatic rotation knife sharpener frame. The orifices are offset to separate the sharpening rods. It must be understood that varying angles may be required for different sharpening requirements and will remain within the scope of this application. Sharpening rod holders with a Teflon® bushing will seat into the angled orifices in the left and right pivot arms. A variety of sharpening rods with different abrasive surfaces can be easily exchanged in the device. The device can be used to sharpen scissors and scissor blades as well as knife blades.

The sharpening rod holders will consist of a lower pivot shaft with a cogwheel central portion including a boss on the top surface. An orifice extends through the sharpening rod holder that will have a slip fit for the metallic sharpening rods, and accommodate a steel end cap placed over the end of ceramic sharpening rods, for a similar slip fit attachment. Sharpening rods may be made from natural or synthetic materials such as diamond coated metal, ceramic, and/or stone. The lower section of the orifice is enlarged to incorporate a magnet to secure the metallic sharpening rods within the sharpening rod holders. The enlargement of the orifice in the lower section retains the magnet when the metallic sharpening rods are removed. Sharpening rod holder retainers are attached to the rear distal ends of the left and right pivot arms by the means of a screw. The sharpening rod holder retainers have been designed to hold the sharpening rod holder in position when the sharpening rods are removed from the resisting force of the magnets. A spring steel actuator is centrally mounted on an actuator mounting block and extends outwardly on each side to engage with the cogwheels on the sharpening rod holders.

When a knife blade is drawn downwardly through the two sharpening rods, the right and left pivot arms are drawn inwardly and the distal ends of the spring steel actuator engage in the cogwheels and rotate them into a new position. When the left and right pivot arms are forced back to their static position by the compression spring the distal ends of the spring steel actuator will re-engage in the next positions on the cogwheels. This action, which is similar to a conventional clock mechanism, produces the automatic rotation of each sharpening rod of the automatic rotation knife sharpener.

While the present automatic rotation knife sharpener has been described herein with reference to particular embodiments thereof, a latitude of modification, various changes and substitutions are intended in the foregoing disclosure. It will be appreciated that in some instance some features of the design will be employed without a corresponding use of other features without departing from the scope of the application as set forth.

BRIEF DESCRIPTION OF THE DRAWINGS

The accompanying drawings, which are incorporated in and form a part of this specification, illustrate embodiments of the automatic rotation knife sharpener and together with the description, serve to explain the principles of this application.

For a fuller understanding of the nature and advantages of the automatic rotation knife sharpener, reference should be had to the following detailed description taken in conjunction with the accompanying drawings which are incorporated in and form a part of this specification, illustrate embodiments of the design and together with the description, serve to explain the principles of this application.

DETAILED DESCRIPTION OF THE PREFERRED EMBODIMENTS

Figure 1:
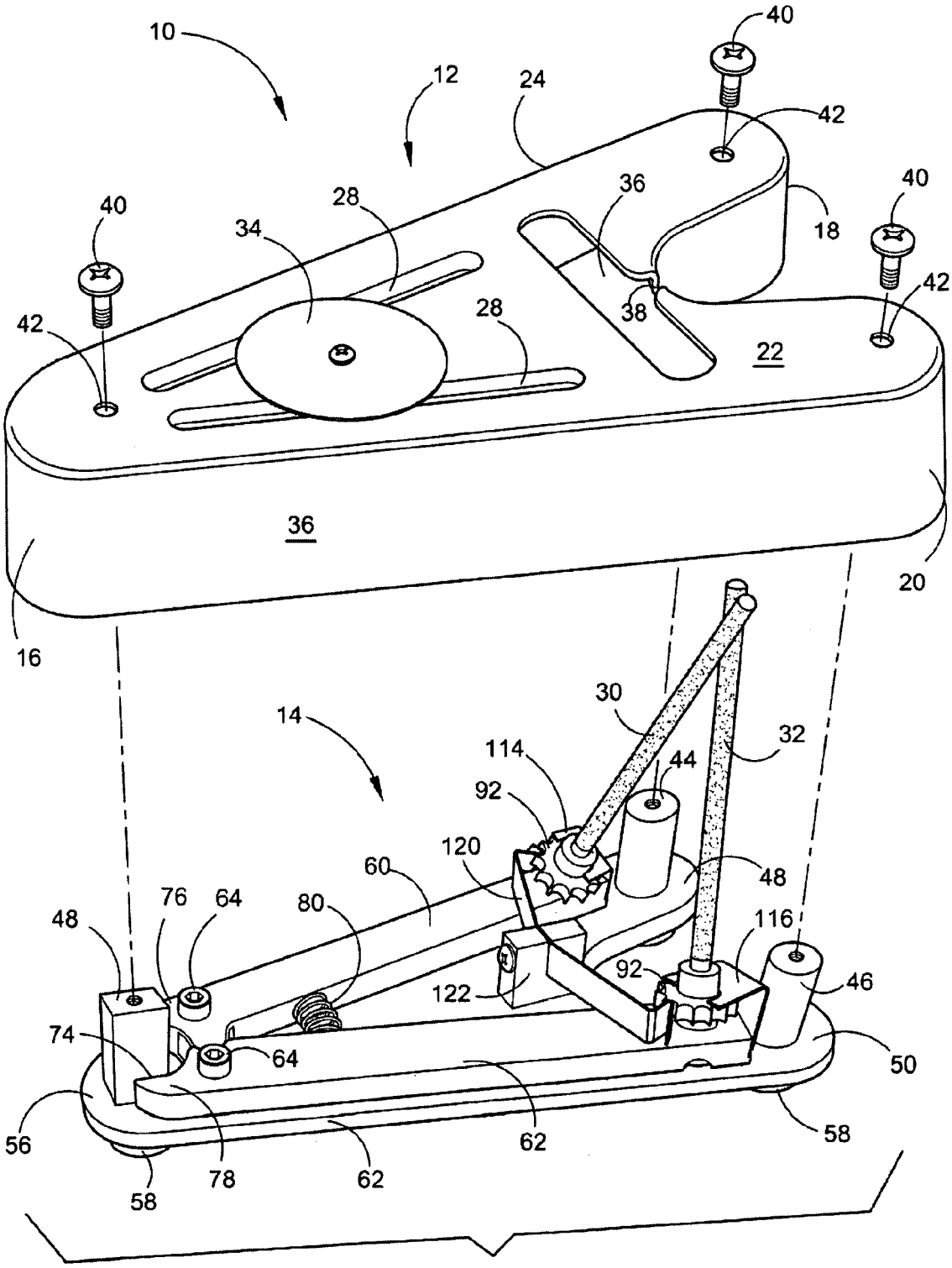
FIG. 1 depicts a perspective view of the automatic rotation knife sharpener with the protective cover raised above the frame assembly.

Referring now to the drawings, wherein similar parts of the automatic rotation knife sharpener 10 are identified by like reference numerals, there is seen in FIG. 1 a perspective view of the automatic rotation knife sharpener 10 with the protective angular shaped cover 12 raised above the frame assembly 14. The protective cover 12 is in an angular shape having a front section 16 and a right rear lobe 18 and a left rear lobe 20 with a protective cover top surface 22 and side surfaces 24 and 26. Two or more storage troughs 28 on the top surface 22 will hold the sharpening rods 30 and 32 when the device is stored. A circular flexible retainer 34 covering a portion of the troughs 28 for the sharpening rods 30 and 32 holds them in place. An elongated orifice 36 at the rear provides a means for the sharpening rods 30 and 32 to translate back and forth through the protective cover 12 during the sharpening operation. A clearance slot 38 at the back of the elongated orifice 36 allows for clearance at the rear when a knife is drawn through the device. Three cover mounting screws 40 attach the protective cover 12 through three orifices 42 into two round pedestals 44 and 46 mounted on the right lobe section 48 and the left lobe section 50 of the automatic rotation knife sharpener frame base 52 and a rectangular pedestal 54 is mounted in the front section 56.

Figure 2:
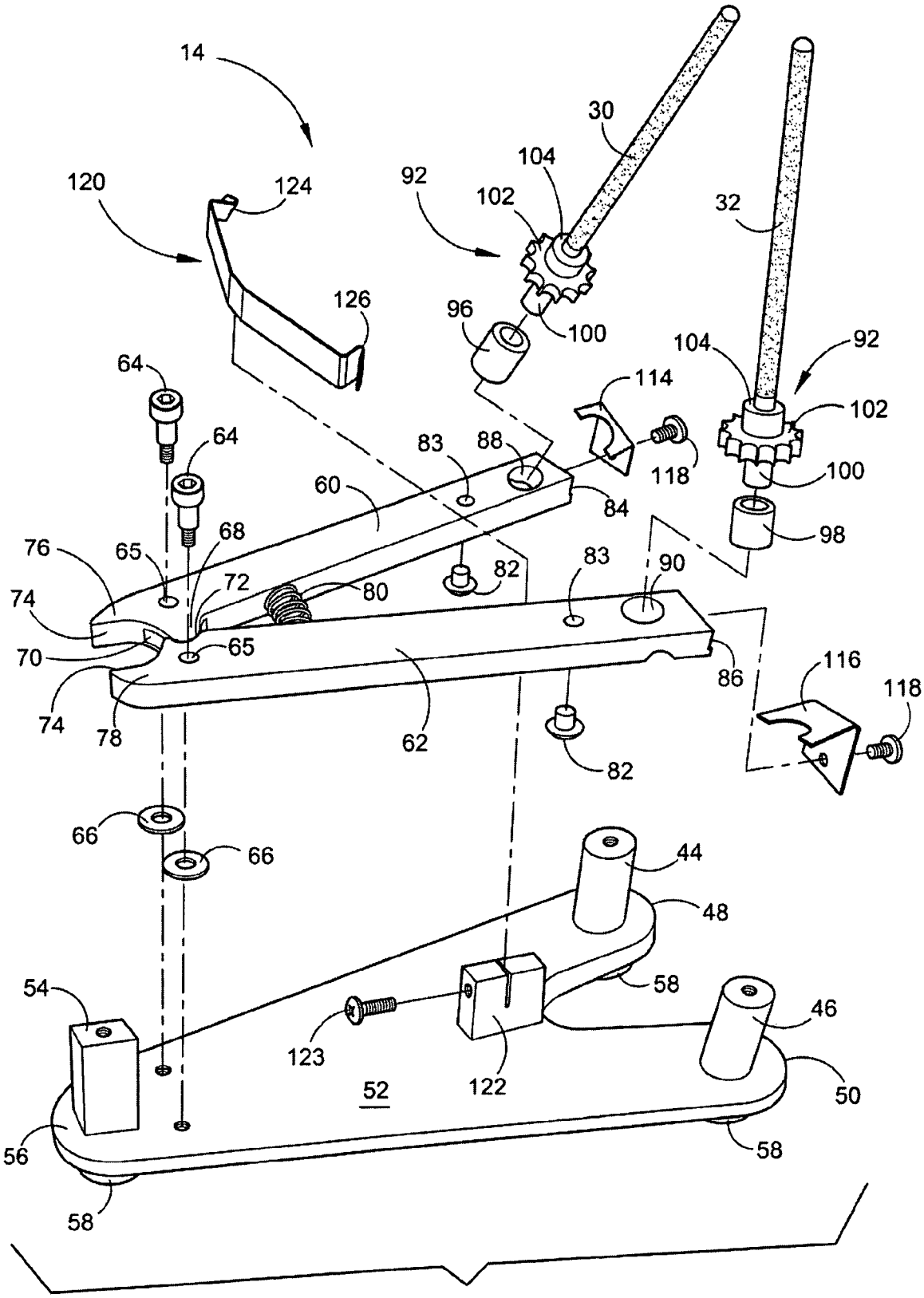
FIG. 2 depicts an exploded perspective view of the automatic rotation knife sharpener frame assembly.

The frame assembly 14 more clearly defined in the exploded view in FIG. 2 consists of a frame base 52 resting on three cushion pads 58. A right pivot arm 60 and left pivot arm 62 are attached to the frame base 52 by the means of socket head shoulder screws 64 through orifices 65 in the right and left pivot arms 60 and 62. Two nylon washers 66 hold the right and left pivot arms 60 and 62 away from the frame base 52. The right pivot arm 60 has an extension 68 with Teflon® insert 70 that mates with a depression 72 in the left pivot arm 62 creating a means whereby the right and left pivot arms 60 and 62 rotate inwardly in unison. Flats 74 on the forward distal ends 76 and 78 of the right and left pivot arms 60 and 62 abut the rectangular pedestal 54 in the front section 56 of the device when the pivot arms 60 and 62 are in the static position. A compression spring 80 holds the right and left pivot arms 60 and 62 apart in the static position.

Nylon glide pins 82 are inserted in orifices 83 providing additional support for the right and left pivot arms 60 and 62 when they translate back and forth in the sharpening operation. At the rear distal end 84, of the right pivot arm 60 and the rear distal end 86 of the left pivot arm 62 are orifices 88 and 90 at opposing angles of twenty-two degrees off perpendicular to the automatic rotation knife sharpener frame base 52.

Figure 3:
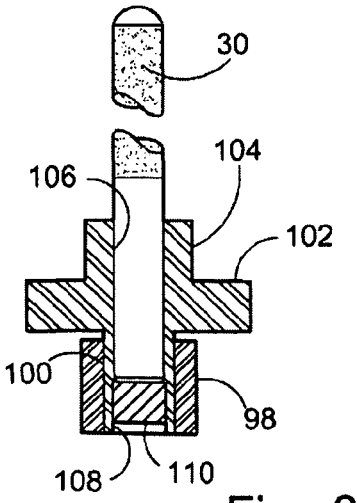
FIG. 3 depicts a section view of one of the knife sharpener rod holders with a sharpener rod inserted.

The orifices 88 and 90 are offset to separate the sharpening rods 30 and 32. Sharpening rod holders 92 are identical with a Teflon® bushing 96 that will seat into the angled orifices 88 and 90 in the left and right pivot arms 60 and 62. The sharpening rod holders 92 illustrated in FIG. 3 will consist of a lower pivot shaft 100 with a cogwheel central portion 102 including a boss 104 on the top surface. A central orifice 106 extends through the sharpening rod holders 92 that will have a slip fit for the metallic sharpening rods 30 and 32. The lower section 108 of the orifice 106 is enlarged to incorporate a magnet 110 to secure the metallic sharpening rods 30 and 32 in place. The enlargement of the orifice lower section 108 retains the magnet 110 when the metallic sharpening rods 30 and 32 are removed.

A right sharpening rod holder retainer 114 and a left sharpening rod retainer 116 are attached to the ends of the left and right pivot arms 60 and 62 by the means of a screw 118. They hold the sharpening rod holders 92 in position when the sharpening rods 30 and 32 are removed from the resisting force of the magnets 110. The right sharpening rod holder retainer 114 and a left sharpening rod retainer 116 are canted at opposing angles to match the inclined angles of the orifices 88 and 90 for holding the sharpening rod holders 92 in position.

A spring steel actuator 120 is centrally mounted on an actuator mounting block 122 by the means of a screw 123 and extends outwardly on each side to engage with the cogwheel central portion 102 on the sharpening rod holders 92. When a knife is drawn downwardly through the two sharpening rods 30 and 32, the right and left pivot arms 60 and 62 are drawn inwardly and the distal ends 124 and 126 of the spring steel actuator 120 engage in the cogwheel central portion 102 of the sharpening rod holder 92 rotating them into a new position. When the left and right pivot arms 60 and 62 are forced back to their static position by the compression spring 80 the distal ends 124 and 126 of the spring steel actuator 120 will re-engage in the next positions on the cogwheel central portion 102 of the sharpening rod holder 92. This action produces the automatic rotation of each of the sharpening rods 30 and 32 for the automatic rotation knife sharpener 10. Ceramic sharpening rods will have metallic, typically steel, end caps to provide for a slip fit on and off the device. The steel end caps will secure to the magnets within the sharpening rod cavities, holding them securely in place on the device while the device is in operation.

Figure 5:
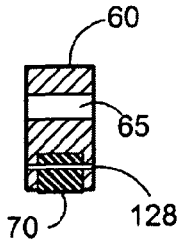
FIG. 5 depicts a section view of the right pivot arm.
Figure 4:
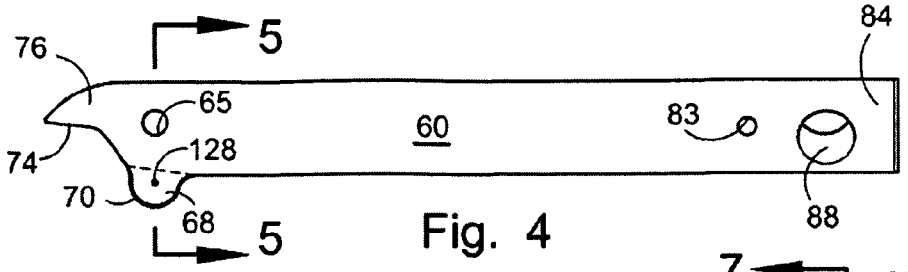
FIG. 4 depicts a top view of the right pivot arm.
Figure 6:
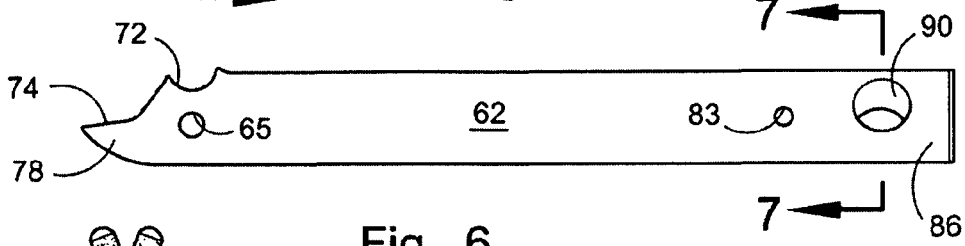
FIG. 6 depicts a top view of the left pivot arm.

FIG. 4 depicts a top view of the right pivot arm 60 illustrating the right pivot arm extension 68 with the Teflon® insert 70 held in place by the means of pin 128 and further illustrated in FIG. 5. The Teflon® insert 70 maintains a smooth action against the depression 72 in the left pivot arm 62 illustrated in the top view of FIG. 6 when a knife blade is drawn through the device. It should be noted that scissors and scissor blades could also be sharpened by the present invention.

Figure 7:
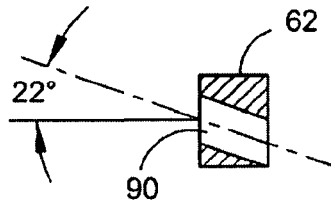
FIG. 7 depicts a section view of the left pivot arm.

FIG. 7 depicts a section view of the left pivot arm 62 further defining the twenty-two degree angle of the left pivot arm orifice 90.

Figure 8:
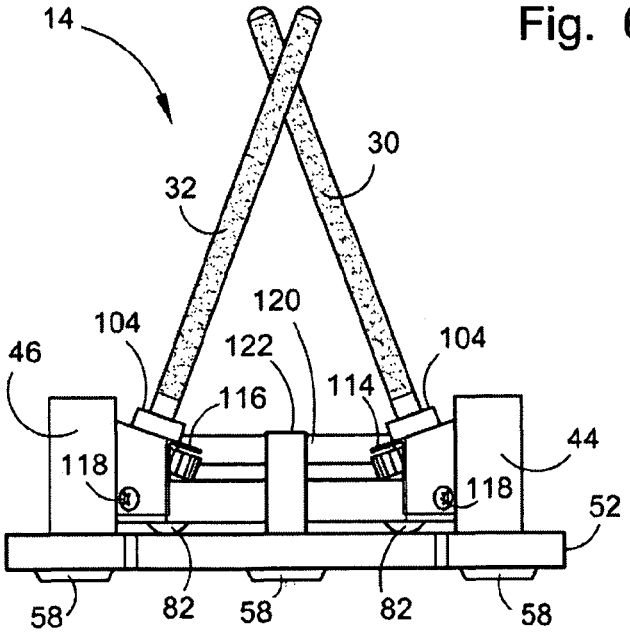
FIG. 8 depicts a rear view of the automatic rotation knife sharpener frame assembly.
Figure 9:
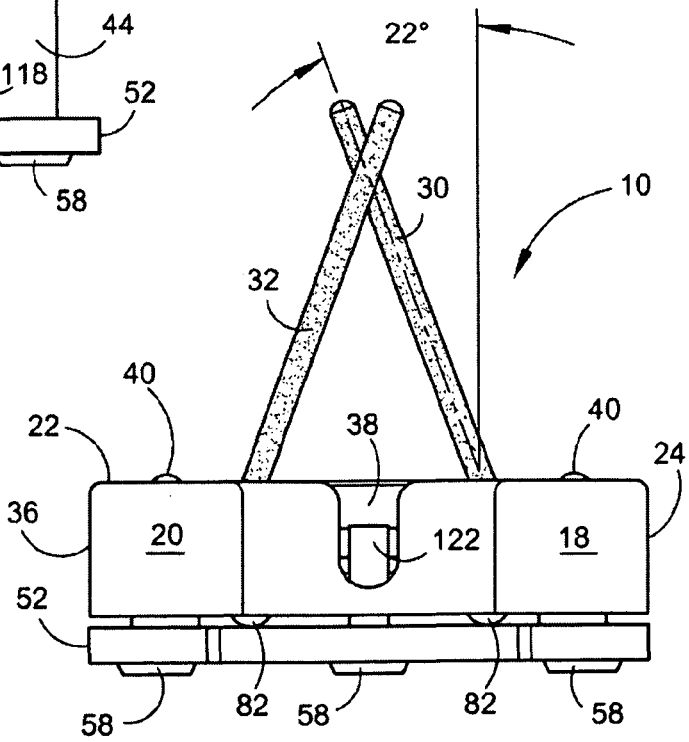
FIG. 9 depicts a rear view of the automatic rotation knife sharpener.

FIG. 8 depicts a rear view of the automatic rotation knife sharpener frame assembly 14 while FIG. 9 depicts a rear view of the automatic rotation knife sharpener 10 illustrating the location of the clearance slot 38 in the protective angular shaped cover 12.

The automatic rotation knife sharpener 10 shown in the drawings and described in detail herein disclose arrangements of elements of particular construction and configuration for illustrating preferred embodiments of structure and method of operation of the present application. It is to be understood, however, that elements of different construction and configuration and other arrangements thereof, other than those illustrated and described may be employed for providing a automatic rotation knife sharpener 10 in accordance with the spirit of this disclosure, and such changes, alternations and modifications as would occur to those skilled in the art are considered to be within the scope of this design as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

I claim:

1. An automatic rotation knife sharpener comprising:

(a) a frame assembly and a protective angular shaped cover raised above said frame assembly wherein said protective cover is in an angular shape having a front section, a right rear lobe and a left rear lobe, with a protective cover top surface and side surfaces;

(b) two or more sharpening rods and two or more storage troughs on said protective cover top surface to hold said sharpening rods when the device is stored;

(c) a circular flexible retainer covering a portion of the troughs for securing said sharpening rods to hold them in place during storage;

(d) an elongated orifice at the rear providing a means for the sharpening rods to translate back and forth through the protective cover during the sharpening operation, and a clearance slot at the back of said elongated orifice which allows for clearance at the rear when a knife blade is drawn through the device; and (e) right and left pivot arms moveably affixed to said frame having a compression spring disposed there between, a cogwheel rotatably attached to each of said right and left pivot arms, having a plurality of cog position notches, a spring steel actuator having proximal and distal ends affixed to said frame at said proximal end, having distal ends engaged with said cog positions of said cogwheel;

whereby when a knife blade is drawn downwardly through the two sharpening rods, the right and left pivot arms are drawn inwardly and the distal ends of the spring steel actuator engage the cogwheels and rotate them into a new position, and when the left and right pivot arms are forced back to their static position by the compression spring the distal ends of the spring steel actuator will re-engage in the next cog position notches on said cogwheel, thereby this action produces the automatic rotation of each sharpening rod.

2. The automatic rotation knife sharpener according to claim 1, wherein said sharpening rods are held in place within angled central orifices at about 22 degrees off perpendicular to the automatic rotation knife sharpener frame base.

3. The automatic rotation knife sharpener according to claim 2, wherein said sharpening rods are constructed of metal or ceramic.

4. The automatic rotation knife sharpener according to claim 3, wherein each of said metal or ceramic sharpening rods include a metallic end cap to provide for a slip fit into said angled central orifices.

5. The automatic rotation knife sharpener according to claim 4, wherein said metallic end caps secure said sharpening rods in place by employing a magnet located in the lower section of said angled central orifices.

6. The automatic rotation knife sharpener according to claim 1, wherein said sharpening rods rotate through actuation of a cogwheel when a blade is drawn downwardly through said one or more sharpening rods.

7. The automatic rotation knife sharpener according to claim 6, wherein said cogwheel is engaged by a spring steel actuator which results in the automatic rotation of said sharpening rods.

8. The automatic rotation knife sharpener according to claim 7, wherein said cogwheel is further secured to said left and right pivot arms by a sharpening rod retainer keeping said cogwheel engaged to said spring steel actuator.

9. The automatic rotation knife sharpener according to claim 8, wherein said left and right pivot arms are moveably held apart by a compression spring.

10. The automatic rotation knife sharpener according to claim 9, wherein said compression spring is constructed of steel.

11. A method for making an automatic rotation knife sharpener comprising the steps of:

(a) providing a frame assembly and a protective angular shaped cover raised above said frame assembly wherein said protective cover is in an angular shape having a front section, a right rear lobe and a left rear lobe, with a protective cover top surface and side surfaces;

(b) providing two or more sharpening rods and two or more storage troughs on said protective cover top surface to hold said sharpening rods when the device is stored;

(c) providing a circular flexible retainer covering a portion of the troughs for securing said sharpening rods to hold them in place during storage;

(d) providing an elongated orifice at the rear providing a means for the sharpening rods to translate back and forth through the protective cover during the sharpening operation, and a clearance slot at the back of said elongated orifice which allows for clearance at the rear when a knife blade is drawn through the device;

(e) providing right and left pivot arms moveably affixed to said frame having a compression spring disposed there between, a cogwheel rotatably attached to each of said right and left pivot arms, having a plurality of cog position notches; and (f) providing a spring steel actuator having proximal and distal ends affixed to said frame at said proximal end, having distal ends engaged with said cog positions of said cogwheel;

whereby when a knife blade is drawn downwardly through the two sharpening rods, the right and left pivot arms are drawn inwardly and the distal ends of the spring steel actuator engage the cogwheels and rotate them into a new position, and when the left and right pivot arms are forced back to their static position by the compression spring the distal ends of the spring steel actuator will re-engage in the next position notches on said cogwheel, thereby this action produces the automatic rotation of each sharpening rod.

12. The method for making an automatic rotation knife sharpener according to claim 11, wherein said step of providing two or more sharpening rods further includes the step of providing two or more sharpening rods wherein said sharpening rods are held in place within angled central orifices at about 22 degrees off perpendicular to the automatic rotation knife sharpener frame base.

13. The method for making an automatic rotation knife sharpener according to claim 12, wherein said step of providing two or more sharpening rods further includes the step of providing two or more sharpening rods wherein said sharpening rods are constructed of metal or ceramic.

14. The method for making an automatic rotation knife sharpener according to claim 13, wherein said step of providing two or more sharpening rods wherein said sharpening rods are constructed of metal or ceramic further includes the step of providing two or more sharpening rods wherein said sharpening rods are constructed of metal or ceramic wherein each of said metal or ceramic sharpening rods include a metallic end cap to provide for a slip fit into said angled central orifices.

15. The method for making an automatic rotation knife sharpener according to claim 14, wherein said step of providing metal or ceramic sharpening rods include a metallic end cap to provide for a slip fit into said angled central orifices wherein said metallic end caps secure said sharpening rods in place by employing a magnet located in the lower section of said angled central orifices.

16. The method for making an automatic rotation knife sharpener according to claim 11, wherein said step of providing one or more sharpening rods further includes the step of providing one or more sharpening rods wherein said sharpening rods rotate through actuation of a cogwheel when a blade is drawn downwardly through said one or more sharpening rods.

17. The method for making an automatic rotation knife sharpener according to claim 11, wherein said step of providing one or more sharpening rods wherein said sharpening rods rotate through actuation of a cogwheel when a blade is drawn downwardly through the two sharpening rods wherein said cogwheel is engaged by a spring steel actuator which results in the automatic rotation of said sharpening rods.

18. The method for making an automatic rotation knife sharpener according to claim 17, wherein said step of step of providing one or more sharpening rods wherein said sharpening rods rotate through actuation of a cogwheel when a blade is drawn downwardly through the two sharpening rods wherein said cogwheel is engaged by a spring steel actuator further includes providing a cogwheel wherein said cogwheel is further secured to said left and right pivot arms by a sharpening rod retainer keeping said cogwheel engaged to said spring steel actuator.

19. The method for making an automatic rotation knife sharpener according to claim 18, wherein said step of providing a cogwheel wherein said cogwheel is further secured to said left and right pivot arms wherein said left and right pivot arms are moveably held apart by a compression spring.

20. The method for making an automatic rotation knife sharpener according to claim 19, wherein said step of providing a cogwheel wherein said cogwheel is further secured to said left and right pivot arms wherein said left and right pivot arms are moveably held apart by a compression spring, further includes the step of providing a compression spring constructed of steel.

* * * * *